US011143493B2

(12) United States Patent
Gaide

(10) Patent No.: US 11,143,493 B2
(45) Date of Patent: Oct. 12, 2021

(54) AMMUNITION CARTRIDGE

(71) Applicant: Albert Gaide, Monnaz (CH)

(72) Inventor: Albert Gaide, Monnaz (CH)

( * ) Notice: Subject to any disclaimer, the term of this patent is extended or adjusted under 35 U.S.C. 154(b) by 0 days.

(21) Appl. No.: 16/769,470

(22) PCT Filed: Dec. 4, 2018

(86) PCT No.: PCT/EP2018/083545

§ 371 (c)(1),
(2) Date: Jun. 3, 2020

(87) PCT Pub. No.: WO2019/110614

PCT Pub. Date: Jun. 13, 2019

(65) Prior Publication Data

US 2020/0386526 A1 Dec. 10, 2020

(30) Foreign Application Priority Data

Dec. 8, 2017 (CH) ..... 01493/17
Jan. 29, 2018 (CH) ..... 00100/18
(Continued)

(51) Int. Cl.
*F42B 5/16* (2006.01)
*F42B 5/10* (2006.01)
(Continued)

(52) U.S. Cl.
CPC ..... *F42B 5/16* (2013.01); *F42B 5/10* (2013.01); *F42B 5/285* (2013.01); *F42B 10/04* (2013.01);
(Continued)

(58) Field of Classification Search
CPC .. F42B 5/16; F42B 45/10; F42B 5/285; F42B 10/04; F42C 19/0826; F42C 19/083; F42C 19/08
See application file for complete search history.

(56) References Cited

U.S. PATENT DOCUMENTS 180,840 A * 8/1876 Bull ..... F42B 5/02 102/430
517,719 A * 4/1894 Aiken ..... F42B 8/02 102/447
(Continued)

FOREIGN PATENT DOCUMENTS

| | | |
|---|---|---|
| BE | 373578 | 10/1930 |
| DE | 3923461 | 1/1991 |
| EP | 0995966 | 4/2000 |

OTHER PUBLICATIONS

International Search Report and Written Opinion issued by the European Patent Office, dated Apr. 17, 2019, for International Patent Application No. PCT/EP2018/083545; 19 pages.
(Continued)

*Primary Examiner* — Joshua E Freeman
(74) *Attorney, Agent, or Firm* — Faegre Drinker Biddle & Reath LLP

(57) ABSTRACT

Ammunition cartridge comprising a rigid casing including a tubular sleeve and a base closing an end of the casing, a projectile mounted at another end of the casing, a propellant charge contained inside the casing, and an ignition device. The ignition device comprises an ignition charge arranged to ignite the propellant charge at a point of ignition distal from the base and proximal the projectile.

21 Claims, 15 Drawing Sheets

(30) Foreign Application Priority Data

Apr. 23, 2018 (CH) ..... 00521/18
Jun. 22, 2018 (WO) ..... PCT/IB2018/054608

(51) Int. Cl.
*F42B 5/285* (2006.01)
*F42B 10/04* (2006.01)
*F42C 19/08* (2006.01)

(52) U.S. Cl.
CPC ..... *F42C 19/083* (2013.01); *F42C 19/0826* (2013.01)

(56) References Cited

U.S. PATENT DOCUMENTS 1,920,075 A * 7/1933 Haenichen ..... F42C 19/0826 102/443
2,294,822 A * 9/1942 Albree ..... F42B 5/285 102/469
2,613,604 A 10/1952 Pyle
2,759,419 A * 8/1956 Hitchens ..... F42C 19/0826 102/202.9
3,312,168 A * 4/1967 Gawlick ..... F42C 19/083 102/200
3,618,521 A * 11/1971 Montesi ..... F02K 9/95 102/531
4,098,190 A * 7/1978 Gawlick ..... F42B 8/20 102/445
4,335,657 A * 6/1982 Bains ..... F42B 5/045 102/433
4,572,078 A * 2/1986 Bell ..... F42C 19/0826 102/200
4,625,648 A * 12/1986 Klein ..... C06B 21/0041 102/286
4,763,577 A * 8/1988 Romer ..... F42B 5/067 102/431
4,823,699 A * 4/1989 Farinacci ..... F42B 14/061 102/439
4,887,534 A * 12/1989 Dickovich ..... F42C 19/0826 102/373
5,160,804 A * 11/1992 Wahner ..... F42B 5/16 102/443
5,272,828 A * 12/1993 Petrick ..... F41A 9/61 42/50
5,289,776 A * 3/1994 Thiesen ..... F42B 5/181 102/431
5,335,599 A * 8/1994 Thiesen ..... F42B 5/16 102/431
5,610,365 A * 3/1997 Thiesen ..... C06C 9/00 102/289
5,625,163 A * 4/1997 Thiesen ..... F42B 12/38 102/439
5,650,589 A * 7/1997 Thiesen ..... F42B 5/181 102/289
6,158,348 A * 12/2000 Campoli ..... F42B 5/16 102/433
8,763,535 B2 * 7/2014 Padgett ..... F42B 12/76 102/467
9,249,759 B1 * 2/2016 Einstein ..... F42C 19/0807
9,273,941 B2 * 3/2016 Carlson ..... F42B 5/045
10,048,052 B2 * 8/2018 Burrow ..... F42B 33/001
10,190,857 B2 * 1/2019 Burrow ..... F42B 5/16
10,429,156 B2 * 10/2019 Burrow ..... F42B 5/307
10,466,022 B2 * 11/2019 Peterson ..... F41A 5/18
10,480,915 B2 * 11/2019 Burrow ..... F42B 5/307
10,914,558 B2 * 2/2021 Burrow ..... F42B 5/30
2002/0157559 A1 * 10/2002 Brunet ..... C06C 9/00 102/472
2002/0195017 A1 * 12/2002 Priimak ..... F42B 5/16 102/470
2006/0096485 A1 * 5/2006 Stark ..... F42B 5/181 102/202
2007/0151473 A1 * 7/2007 Brunn ..... F42C 19/083 102/444
2007/0289474 A1 * 12/2007 Mutascio ..... F42C 19/0826 102/431
2016/0018199 A1 * 1/2016 Nemec ..... F42B 12/74 102/439
2018/0238665 A1 * 8/2018 Dumont ..... F42B 5/26
2018/0292186 A1 * 10/2018 Padgett ..... F42C 19/083
2019/0033045 A1 * 1/2019 Mohler ..... F42B 5/285

OTHER PUBLICATIONS

International Preliminary Report on Patentability issued by the International Bureau of WIPO, dated Jun. 9, 2020, for International Patent Application No. PCT/EP2018/083545; 12 pages.

* cited by examiner 6
35
38
40
37
16
33
52
14
36
22
34
10
32
30
46
61
26
28
6
2
16
14

Fig. 7a
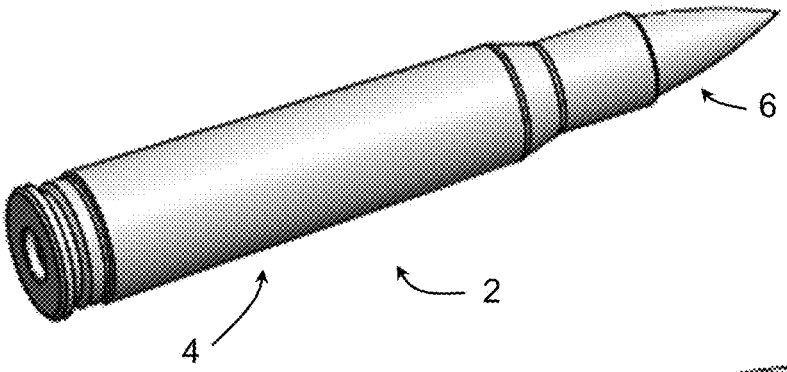
Fig. 7b
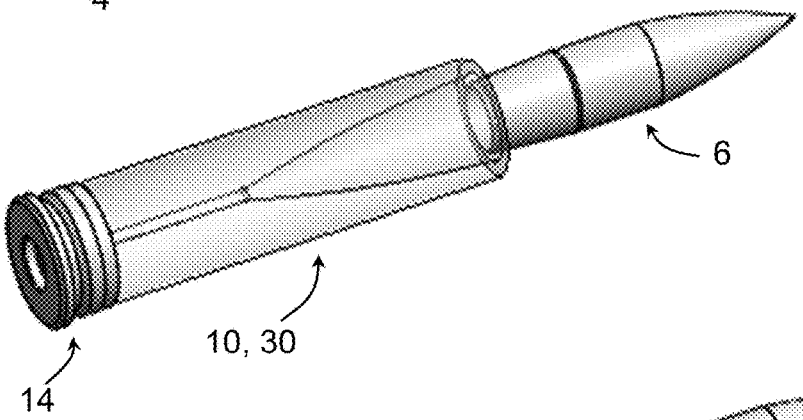
Fig. 7c
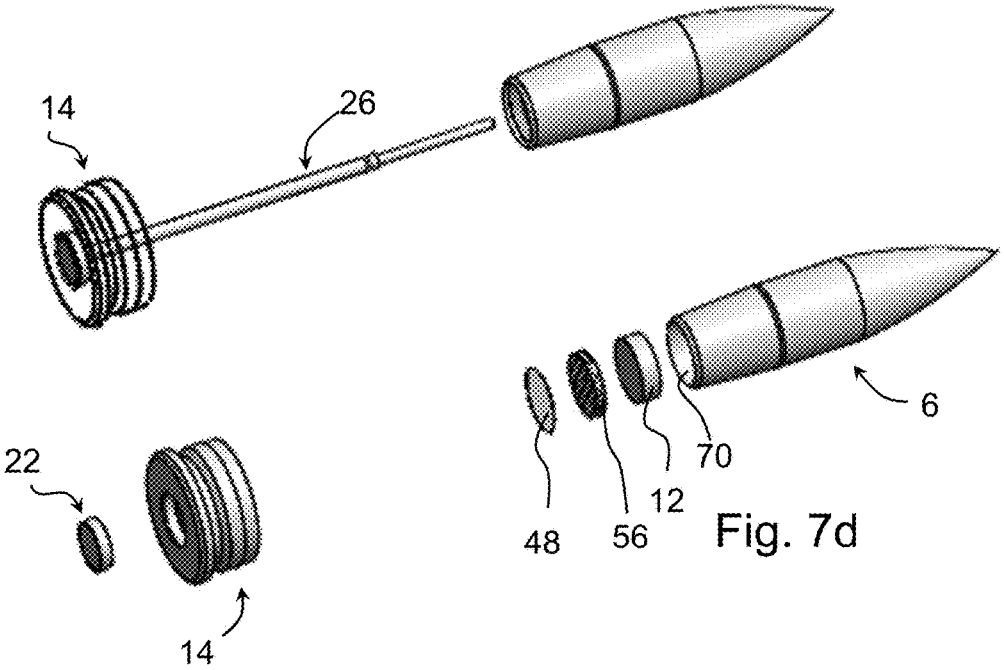
Fig. 7d 15
15
9
15

11
19
9

11
9

11
16
9

3
5
7
11
9

17
19

11
5
38
40
16
9

17
21

17
38
21

7
7
16

17
7
11
9
16
7
11
9

AMMUNITION CARTRIDGE

CROSS-REFERENCE TO RELATED APPLICATIONS

The present application is a national stage entry of International (PCT) Patent Application Number PCT/EP2018/083545, filed Dec. 4, 2018, which in turn claims priority to Swiss Patent Application No. 01493/17, filed Dec. 8, 2017; Swiss Patent Application No. 00100/18, filed Jan. 29, 2018; Swiss Patent Application No. 00521/18, filed Apr. 23, 2018; and PCT International Patent Application No. PCT/IB2018/054608, filed Jun. 22, 2018, the subject matter of which are expressly incorporated herein by reference.

FIELD OF THE INVENTION

This invention relates to an ammunition cartridge, in particular for rifles and firearms.

BACKGROUND OF THE INVENTION

Conventional ammunition cartridges for firearms and guns of various sizes and purposes typically comprise a brass casing containing a propellant charge in the form of powder or granules of an explosive substance, and a projectile assembled in a gripping fit at an open tubular sleeve end of the casing. Although various ignition systems have been developed, the most common ignition systems for ammunition cartridges comprise an ignition charge mounted in a primer cap located on the casing base wall that ignites upon impact by a firing pin of the weapon. The ignition charge ignites the propellant charge whereby during the explosion the projectile is accelerated in the barrel of the weapon. Since the ignition of the propellant starts from the base wall of the cartridge, propellant powder is ejected from the casing during combustion, a portion of the propellant substance finishing its combustion in the barrel chamber of the weapon.

The pressure generated by combustion of the propellant substance must not exceed a certain level in order to prevent damage to the weapon. In many conventional weapons the pressure generated by the combusting propellant should not exceed around 4000 bars. This limits the propulsion force that the propellant charge can impart. Moreover, in conventional ammunition cartridges, the propellant is often not optimally consumed. Due to the projection of propellant substance out of the casing the combustion of the substance occurs at lower temperatures. It also may depend to a certain extent on the characteristics of the weapon, in particular manufacturing tolerances and wear that influences the fit between the projectile and the barrel chamber and the fit between the casing and the combustion chamber.

Although ammunition cartridges are manufactured in very large quantities, the brass casings are relatively costly to manufacture. Conventional casings are made of a single deep drawn piece of brass or steel and filled from the open end with propellant in powder form before fitting the projectile.

SUMMARY OF THE INVENTION

In view of the foregoing it is an object of the invention to provide an ammunition cartridge with improved performance, in particular that allows to generate a high and well controlled acceleration of the projectile without exceeding the chamber pressure tolerance.

It is advantageous to provide an ammunition cartridge that is economical to manufacture in large quantities, and to provide a method and tools for enabling the aforegoing.

It is advantageous to provide an ammunition cartridge that is light, compact, and uses less materials for a given performance, and to provide methods and tools for enabling the aforegoing.

It is advantageous provide improved ammunition cartridges that can be used in existing weapons.

Objects of this invention have been achieved by providing the ammunition cartridge according to claim 1.

Objects of this invention have been achieved by providing the method of producing an ammunition cartridge according to claim 23.

Objects of this invention have been achieved by providing a tool mechanism for producing an ammunition cartridge according to claims 29 and 31.

Dependent claims recite various advantageous features or variants.

Disclosed herein, according to an aspect of the invention, is an ammunition cartridge comprising a rigid casing including a tubular sleeve and a base closing an end of the casing, a projectile mounted at another end of the casing, a propellant charge contained inside the casing, and an ignition device, wherein the ignition device comprises an ignition charge arranged to ignite the propellant charge at a point of ignition distal from the base and proximal the projectile.

In an advantageous embodiment, the ignition device comprises a movable transmission pin extending from the base to the ignition charge positioned proximal the projectile, the transmission pin being actuable by means of a firing pin or hammer, which may be of a conventional weapon, impacting an ignition cap on the base wall.

In an advantageous embodiment, the ignition charge is positioned in an ignition cap located at the base of the cartridge and the ignition device comprises a guide channel configured to channel the deflagration effect of an ignition charge under combustion to one or more nozzles at an ignition end of the guide channel proximal the projectile, the ignition charge located in the cap being actuable by means of a firing pin or hammer, which may be of a conventional weapon, impacting the ignition cap on the base wall.

In an advantageous embodiment, the propellant charge comprises a plurality of portions of different composition or properties with different combustion characteristics.

In an embodiment, at least two of said portions of propellant charge have different densities.

In an embodiment, at least two of said portions of propellant charge have different chemical compositions.

In an advantageous embodiment, any one or more of the propellant charge portions comprise components that retard and/or accelerate the combustion process.

In an embodiment, at least two charge portions are separated by at least one combustion speed regulation material selected to either retard or to accelerate combustion.

In an advantageous embodiment, the propellant charge is in a solid self-supporting preform.

In an advantageous embodiment, the propellant charge comprises a concave face facing towards the point of ignition.

In an advantageous embodiment, the propellant charge solid self-supporting preform comprises a combustion powder held together with a binding material.

In an advantageous embodiment, the binding material is selected from a group consisting of a starch-based material, a polymer based material, a curable polymer, a thermosetting polymer, a thermoplastic polymer, or a gelatin material.

In an embodiment, the propellant charge solid self-supporting preform comprises an outer supporting layer.

In an advantageous embodiment, the ammunition cartridge further comprises a projectile booster charge positioned adjacent a trailing end of the projectile, the point of ignition of the projectile booster charge positioned adjacent the ignition device such that the projectile booster charge is ignited simultaneously or before the propellant charge is ignited.

In an advantageous embodiment, the projectile comprises a booster charge located in the base of the projectile positioned adjacent the ignition device such that it is ignited simultaneously or before the cartridge propellant charge is ignited.

In an advantageous embodiment, the ignition charge and the booster charge are located adjacent to each other at the base of the projectile such that the booster charge located in the projectile is ignited simultaneously or before the propellant charge is ignited.

In an advantageous embodiment, the projectile booster charge is positioned in a cavity in the trailing end of the projectile.

In an advantageous embodiment, the point of ignition is separated by a thin protective film from the propellant charge.

In an advantageous embodiment, the casing is made of at least two parts including the base and the tubular sleeve that are assembled together.

In an advantageous embodiment, said base and tubular sleeve are welded.

In an advantageous embodiment, the ammunition cartridge further comprises a thermal insulator positioned between the base and the propellant charge.

In an embodiment, the projectile comprises aerodynamic tail fins at a trailing end of the projectile.

Also disclosed herein, according to another aspect of the invention, is a method of producing an ammunition cartridge comprising a rigid casing a projectile, a propellant charge and an ignition device, comprising:

(i) forming the propellant charge in a solid self-supporting preform, (ii) separately forming a tubular sleeve of the casing and a base of the casing, (iii) inserting the solid preform propellant charge and the ignition device in the tubular sleeve through a base end of the tubular sleeve and assembling the base to the tubular sleeve, (iv) assembling the projectile to the tubular sleeve.

In an advantageous embodiment, the ignition device comprises a transmission pin and an ignition cap assembled to said base prior to assembly of the base to the tubular sleeve.

In an advantageous embodiment, the propellant charge is assembled to the ignition device prior to assembly in the tubular sleeve.

In an advantageous embodiment, the ignition device comprise an ignition pin embedded in the propellant charge prior to assembly in the tubular sleeve, the transmission pin extending from the base of the casing to the ignition charge positioned proximal or at the base of the projectile, the transmission pin being actuable by means of a firing pin or hammer, which may be of a conventional weapon, impacting an empty ignition cap located on the base of the casing.

In an advantageous embodiment, the forming of the propellant charge comprises adding a binder material to a combustible propellant substance in powder form and binding the powder in a mold die comprising a shape of the preform.

In an advantageous embodiment, assembling the base to the tubular sleeve comprises welding the base to the tubular sleeve.

In an advantageous embodiment, forming the tubular sleeve includes the operations of:

(i) inserting a tool insert assembly inside a cylindrical tube, the tool insert assembly having a portion with a shape corresponding to an internal shape of the cartridge casing and formed of at least two parts including a shaping insert and a support pin that slidably inserts into a central passage of the shaping insert, the shaping insert comprising a radially compressible body portion that allows the shaping insert to move elastically radially inwardly when the support pin is removed, (ii) compressing the tubular sleeve to deform it against the tool insert assembly, (iii) withdrawing the support pin and subsequently withdrawing the shaping insert.

Also disclosed herein, according to another aspect of the invention, is a tool mechanism for forming a casing of an ammunition cartridge, comprising a tool insert assembly having a portion with a shape corresponding to an internal shape of the cartridge casing, the tool insert assembly formed of at least two parts including a shaping insert and a support pin that slidably inserts into a central passage of the shaping insert, the shaping insert comprising a radially compressible body portion that allows the shaping insert to move elastically radially inwardly when the support pin is removed.

In an advantageous embodiment, the support pin comprises a bore finishing tool portion having cutting edges to machine an inside diameter of a neck portion of the casing upon withdrawal of the support pin.

Also disclosed herein, according to another aspect of the invention, is a tool mechanism for forming a rigid casing of an ammunition cartridge, the casing comprising a base and a tubular sleeve, the tool mechanism configured to form longitudinal grooves in the tubular sleeve to increasing buckling resistance, comprising a swaging operation that generates longitudinal grooves in a flat metal band and a folding operation to fold the metal band into a tube, a longitudinal seam of the tube, formed by longitudinal edges of the metal band coming together, being subsequently welded. The metal band may advantageously be made of steel, instead of brass conventionally used in ammunition cartridges, to reduce costs and weight of the ammunition cartridge.

Further objects and advantageous aspects of the invention will be apparent from the claims, and from the following detailed description and accompanying figures.

BRIEF DESCRIPTION OF THE DRAWINGS

The invention will now be described with reference to the accompanying drawings, which by way of example illustrate embodiments of the present invention and in which:

FIG. 7*a* is a perspective view of an ammunition cartridge according to another embodiment of the invention;

FIGS. 7*b*, 7*c* and 7*d* are various perspective view of components of the cartridge of FIG. 7*a;*

DETAILED DESCRIPTION OF EMBODIMENTS OF THE INVENTION

Figure 1A:
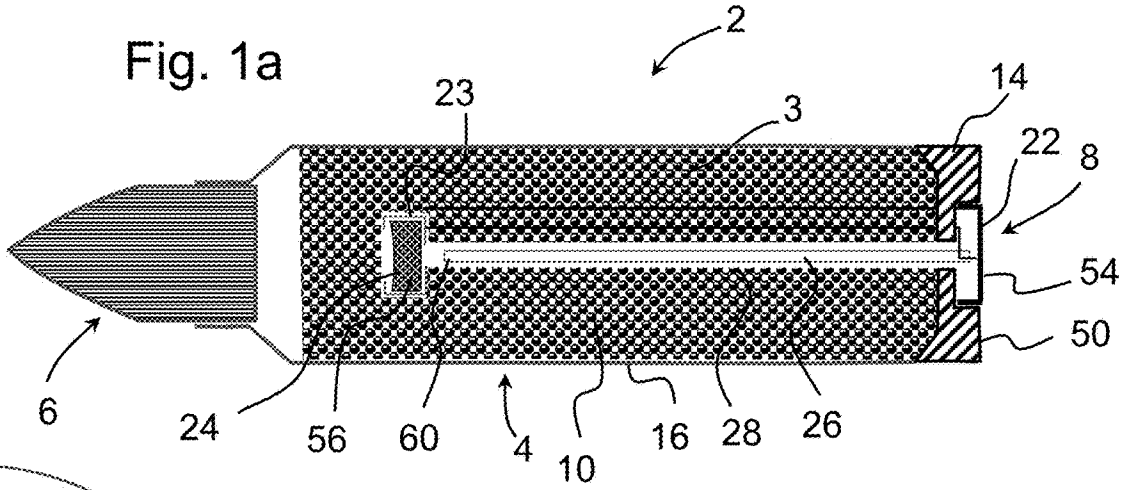
FIG. 1*a* is a schematic cross-sectional view of an ammunition cartridge according to a first embodiment of the invention.

Referring to the figures, an ammunition cartridge 2 comprises a casing 4, a projectile 6, an ignition device 8, and a propellant charge 10. The projectile 6 may have various materials and geometric properties that are per se known in the field of ammunition cartridges and has a diameter configured for a barrel chamber of a weapon. The ammunition cartridge outer shape and dimensions may be configured to conform to a standard size for use with existing weapons, in replacement of existing ammunitions cartridges. The enclosed illustrations and following description are not intended to be limited to any particular caliber of ammunition, it being understood that the principles underlying the invention may be implemented in ammunition cartridges of various dimensional specifications.

The casing 4 generally has a cylindrically shaped tubular sleeve 16 closed at one end by a base 14 at the opposed open end receiving the projectile 6. The projectile receiving end, as is well-known in the art, comprises a neck portion 38 connected via a tapered portion to a major portion 37 of the tubular sleeve portion containing the propellant charge 10, the neck portion 38 having a smaller diameter than the major portion 37. The outer shape of the base may have various configurations depending on the weapon with which it is intended to be used, and may for instance typically comprise a rim 34 and annular groove 36 that serve to eject the casing from the firing chamber of the weapon as is per se well-known in the art.

In an embodiment of the present invention, the casing 4 may be made of a single piece part, for instance a single piece metal part, according to conventional manufacturing processes.

In an advantageous embodiment, the casing may be made of two or more parts, with at least a cylindrical body or sleeve and a base, that are assembled together, by welding, soldering, crimping or other per se known assembling techniques. The multi-part casing allows assembly of the propellant charge 10 into the casing tubular sleeve from the base end 33 before assembly of the base 14 to the tubular sleeve 16, or in a conventional manner from the open neck end 35 once the multi-part casing is assembled. In the embodiment illustrated in FIGS. 3*a* and 3*b*, the base 14 is provided with a tubular connection portion 52 that inserts in the open base end 33 of the tubular sleeve 16 and may be welded by various welding techniques such as Laser welding, Electron-beam welding, friction welding, induction welding and other known welding techniques. The two parts may also be crimped together.

The propellant charge 10 may be in the form of powder or granules as per se known in the art. In an advantageous embodiment according to this invention, the propellant charge is bound in a preform that forms a solid body insertable into the tubular sleeve 16 of the casing 4. The preform may comprise a combustible substance bound together with a binding material.

Various substances with binding properties may be used such as resins, plastics, or asphaltics that hold together a charge of finely divided particles and increase the mechanical strength of the resulting propellant block.

The propellant that has exclusively been used for a long time in conventional military weapons is the so-called smokeless powder or "Gun Powder". Whether single-base powder (e.g. nitrocellulose), double-base powder (e.g. nitrocellulose plus nitroglycerine) or triple-base powder (e.g. nitrocellulose plus nitroglycerine plus nitroguanidine) these propellants undergo a variety of manufacturing processes providing a pasta-like colloidal mixture of thermoplastic behavior that can be extruded through a variety of dies or mechanically pressed into forms.

The more recent development of low-vulnerability ammunition (LOVA) has led to the use of plastic propellants. They are embedded in curable plastics, thermoset materials, thermoplasts or gelatinizers to form a mixture that can be given various shapes by means of hydraulic mold presses and cutting machines for example. LOVA powders correspond to the traditional Gun Powders and can be adapted according to the desired ballistic characteristics. Propellants can also be mixed with or embedded in various curable or poly-additive plastics such as polysulfides, polyurethane, acrylic acid and the like, or mixed with Silicon, petroleum jelly or gelatinized compounds of plastiline like consistency and given a variety of desired forms. Pre-forming may not be limited to the external dimensions and shapes, it can also include embedded details such as cylindrical or conical apertures that increase the combustion surface and contribute in the steady production of gas.

The propellant charge preform may be formed as an individual component that is inserted and assembled to the other components of the ammunition cartridge. In a variant, the propellant charge preform may be formed directly within the cylinder portion of the casing. In a variant, the propellant charge preform may be formed around the ignition device before assembly into the casing. In a variant, propellant charges can be filled in the casing between pre-inserted thin discs or cylindrical walls that have been forced in the casing shell and act as separators. When the propellant is of granular, gelatinous or viscous nature, the preform may also be surrounded partially or fully by a coating, film or thin layer of material that keeps or helps to keep the preform in its intended shape for assembly. The layer of material may for instance be polymer based, paper based, starch based, or gelatinized. In the latter variants, the propellant charge within the center of the preform may be generally loose or held together with a binder material.

The principle purpose of the preform is to allow assembly within the casing, however depending on the embodiment, the binding properties of the preform do not necessarily need to withstand transport and shock once the ammunition cartridge has been fully assembled.

Although the projectile 6 may adopt an essentially conventional shape and use conventional materials as per se well-known in the art, according to an advantageous embodiment of the invention allowing a larger free space inside the cartridge, the projectile may comprise tail fins 64 on the trailing side of the projectile. The fins are configured aerodynamically to provide stable flight to the projectile for use with a weapon with a smooth barrel chamber. In a variant, the fins may be configured to impart a rotational spin to the projectile for use with a smooth barrel chamber of a weapon.

According to an advantageous aspect of the invention, the ignition device comprises a point of ignition 23 that is at a position distal from the base 14 and proximate the projectile 6.

In an embodiment, the ignition device 8 extends from an actuation end 54 positioned on the base 14 of the casing 4, to an ignition end 24 forming the point of ignition that is positioned distal from the base and proximate the projectile 6, configured to ignite the propellant 10 at a position distal from the base 14 and proximate the projectile 6.

According to this aspect of the invention, the propellant thus combusts starting from a position proximate the projectile 6 and thus proximate the neck portion 38 of the casing to generate gas, the direction of combustion moving like in a rocket engine from the projectile end 35 towards the base such that combustion of the propellant occurs within the casing 16 because the pressure generated will oppose the un-combusted propellants from moving into the barrel as this is the case when ignition occurs in the base part of the cartridge.

Figure 14A:
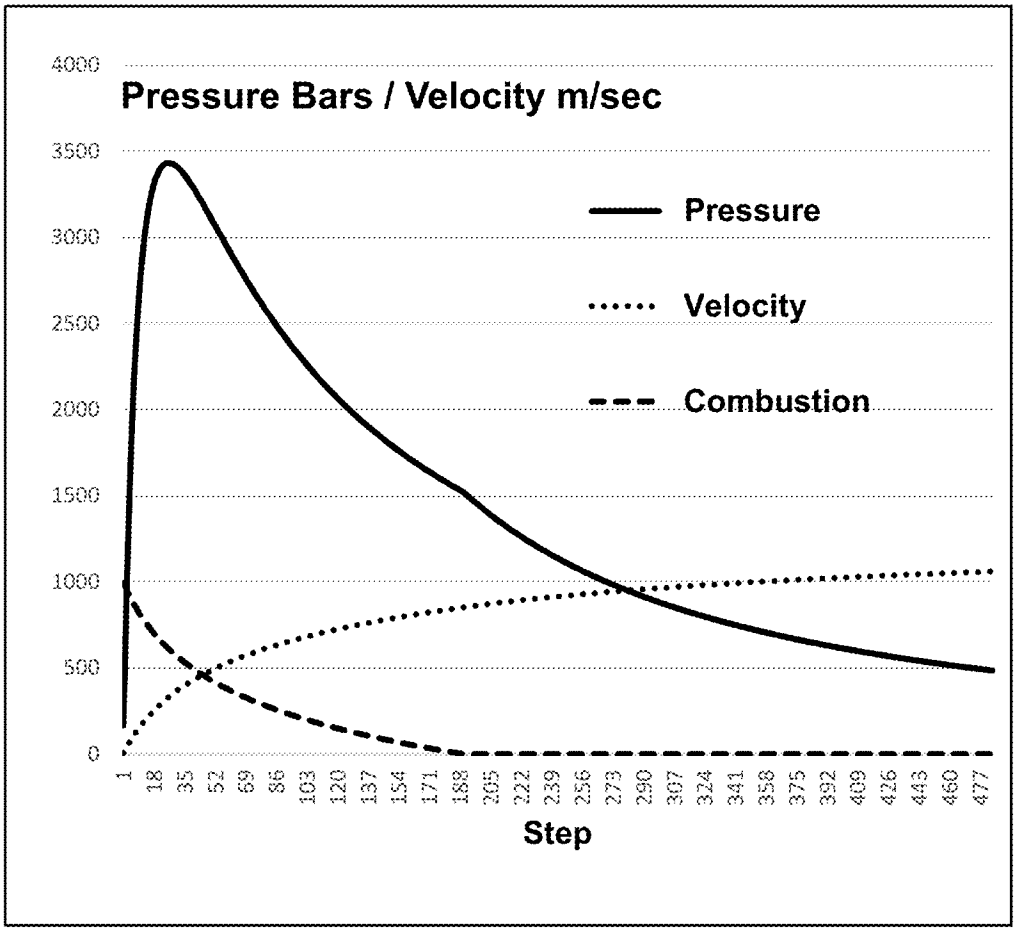
FIG. 14*a* is a graphical representation of the pressure, velocity and combustion profiles of a simulated combustion process using a single propellant and a traditional ignition at the base of the cartridge.

FIG. 14*a* shows the pressure, velocity and combustion profiles derived from a numerical simulation model of the interior ballistic process in the case of a traditional ignition at the base of the cartridge. The combustion profile shows that the propellant ends burning when the projectile has progressed about a third of the barrel length, which means that gun powder propelled with the projectile burns to a large extent in the lower part of the barrel.

According to embodiments of the invention, preventing un-combusted propellants to move into the barrel very advantageously ensures a better control of the combustion and the projectile acceleration process. Since un-combusted propellant is not projected into the barrel chamber of the weapon its combustion does not occur at a lower temperature and it does not absorb part of the kinetic energy transferred to the projectile within the barrel chamber. As the combustion of the propellant occurs essentially within the casing, the projectile is displaced in the barrel with a greater rate of progression than with a conventional ignition starting from the base wall. Since the propellant (which would otherwise be displaced in a conventional ignition) can represent a two-digit percentile of the total mass propelled in the barrel, the projectile according to embodiments of the invention, receives an additional propulsion of corresponding kinetic energy. This can either be useful to increase the speed of the projectile, or for a projectile to be propelled at a given speed, to reduce the volume of the propellant charge required and thus if wanted, the size of the ammunition cartridge.

Figure 1B:
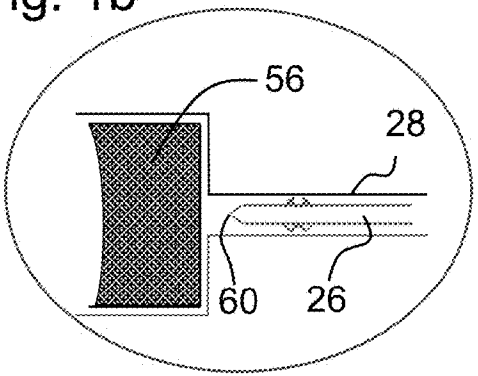
FIG. 1*b* is a schematic detailed view of a portion of an ignition device of the cartridge of FIG. 1*a;*

Ignition of the propellant charge 10 at a position proximal the projectile 6 may be achieved in various manners according to embodiments of the invention. In an embodiment as schematically illustrated in FIGS. 1*a* and 1*b*, the ignition device comprises a transmission pin 26 slidably mounted in a guide channel 28 extending from the base 14 to an ignition charge 56 proximal the projectile 6 that forms the point of ignition. The transmission pin 26 may be actuated by means of a firing pin or hammer of a conventional weapon that hits an ignition cap 22 on the base wall 14. The transmission pin 26 is displaced when the ignition cap is deformed by the weapon's firing hammer or pin. The ignition tip 60 of the transmission pin 26 hits the ignition charge 56 and generates a spark or heat due to the rapid movement of the transmission pin tip and its impact with the ignition charge or other element in proximity of the ignition charge. The guide channel may either be formed in a tubular sleeve of material, such as a hollow polymer or metal tube, or the guide channel may be formed directly in the propellant charge without a separate tubular sleeve.

Figure 2:
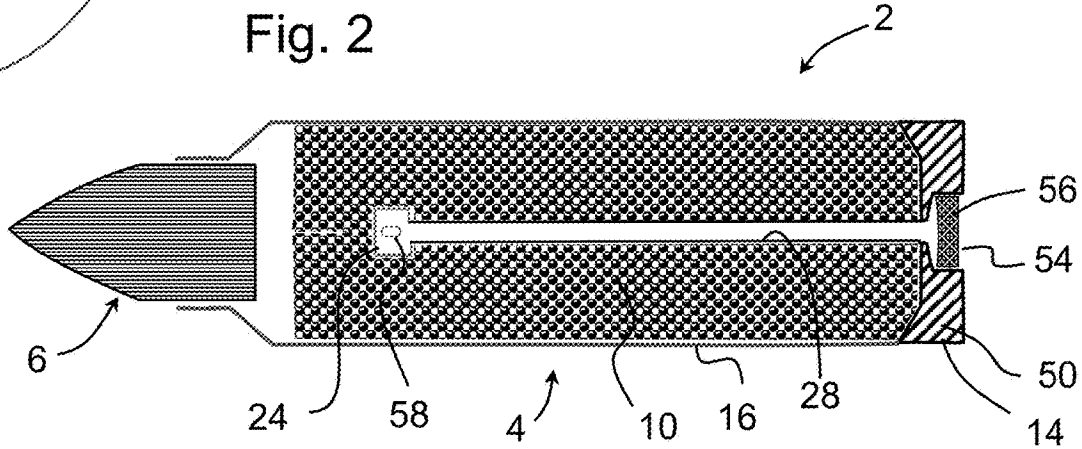
FIG. 2 is a schematic cross-sectional view of an ammunition cartridge similar to FIG. 1*a* but of a variant.

In a variant illustrated in FIG. 2, the ignition charge 56 is positioned at the base 14 of the cartridge and ignited by a firing pin or hammer of the weapon deforming the ignition cap 22, similar to a conventional ammunition cartridge ignition process, whereby in this variant the guide channel 28 does not contain a transmission pin but instead channels the ignition charge under combustion to one or more nozzles 58 at the ignition end 24 of the guide channel 28 that ignite the propellant charge 10 proximal the projectile 6, the nozzles thus forming the point of ignition in this embodiment. The nozzles may for instance comprise a plurality of radially directed nozzles.

Figures 3A, 3B:
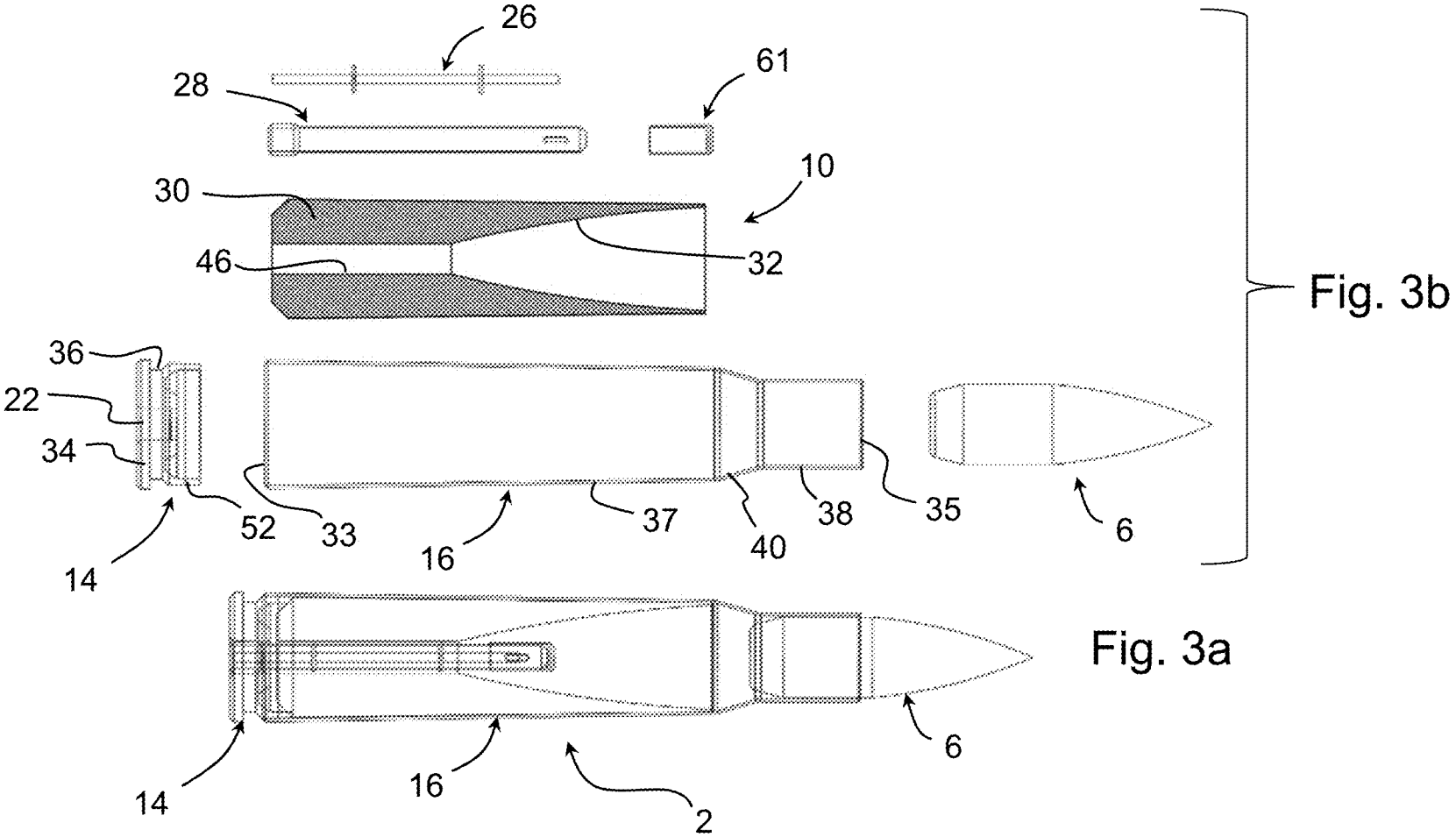
FIG. 3*a* is a view of an ammunition cartridge, illustrated with transparency to show internal parts, according to an embodiment of the invention.
FIG. 3*b* shows the disassembled parts of the cartridge of FIG. 2*a;*

The ignition device may further comprise a cap 61 as illustrated in FIG. 3*a*, for instance made of a plastic or paper-based material that separates the transmission pin 26 and/or ignition end 24 of the guide channel 28 from the ignition charge 56, for increased protection against inadvertent ignition. The cap 61 may be pierced or ruptured by the pin or by the expanding ignition charge. The cap 61 may also serve to prevent propellant charge substance from entering the guide channel 28.

Figure 3C:
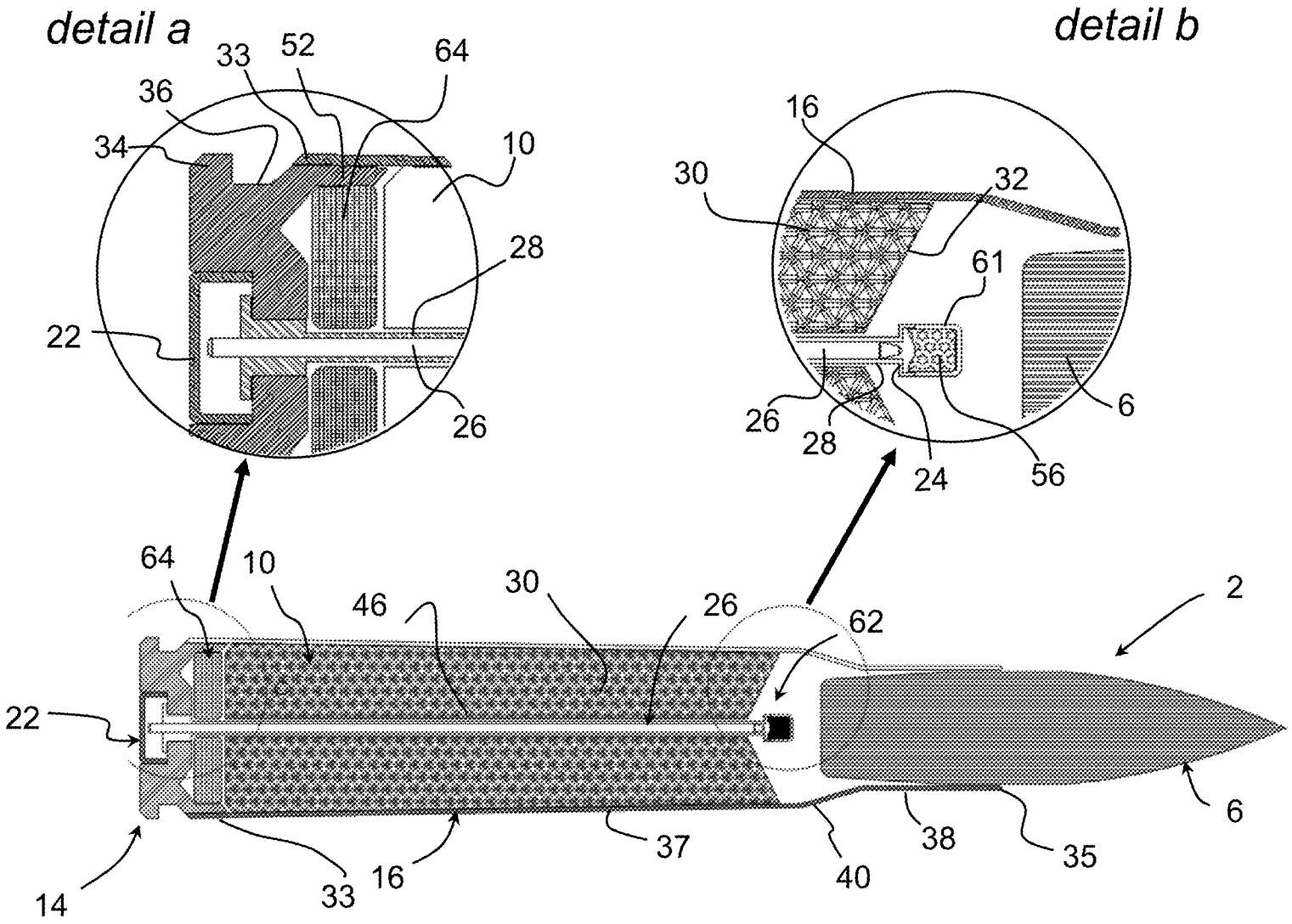
FIG. 3*c* is a schematic cross-sectional view of an ammunition cartridge, illustrated to show the internal parts, including enlarged detail views a and b showing ignition cap and ignition point ends respectively, according to an embodiment of the invention.

In a variant similar to the embodiment illustrated in FIG. 3*c*, the firing pin can be simply embedded in the pre-formed charge 10 which can act as guide and as a blocking agent preventing any motion of the pin unless it is displaced by the weapon's hammer acting on the percussion cap.

Referring now to FIGS. 7*a* to 8*b*, in an advantageous embodiment, the ignition cap can be positioned in the trailing end 75 of the projectile. This arrangement offers a simple way of holding the ignition cap in the front part of the cartridge and provides an important safety measure. The cartridge can be filled with propellant and can be assembled without the presence of sensitive ignition materials that may detonate if un-advertently mishandled. With an ignition cap located in the base of the projectile the sensitive ignition charge can be inserted at the last elaboration step.

In variants, the ignition device may be activated by other means than by a firing pin. For instance, electrical or electromagnetic trigger mechanisms have been developed and are known in the art, such means also being implementable in the present invention for igniting the ignition charge 56.

Figure 4B:
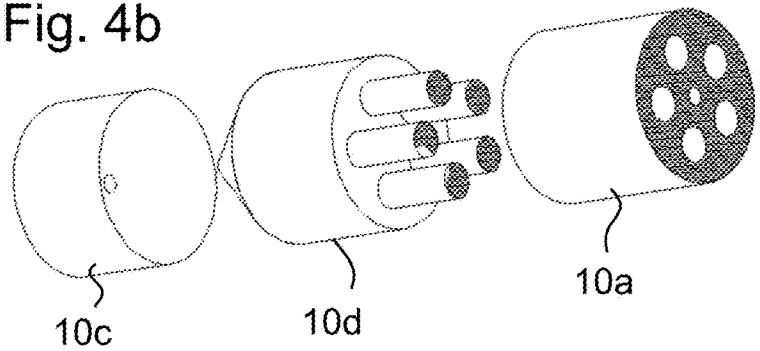
FIG. 4*b* is a perspective view of pre-formed and imbricated propellant charges according to another embodiment of the invention.
Figure 5:
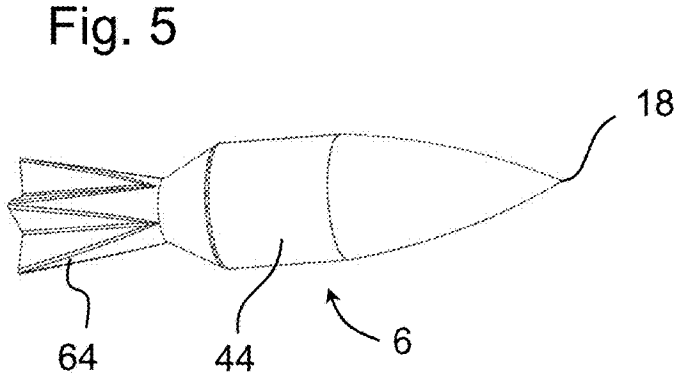
FIG. 5 is a perspective view of a projectile of a cartridge according to an embodiment of the invention.
Figure 4A:
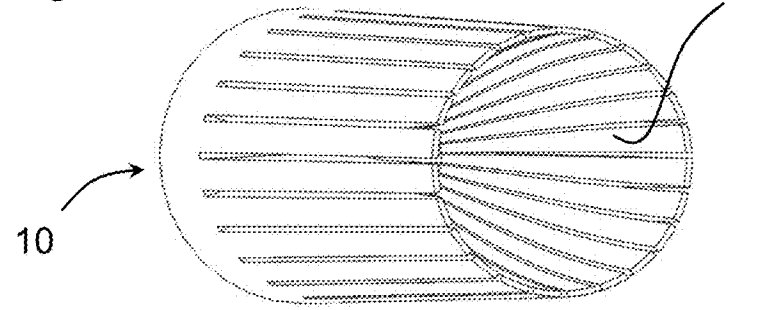
FIG. 4*a* is a schematic perspective view of a propellant charge according to an embodiment of the invention.
Figure 4C:
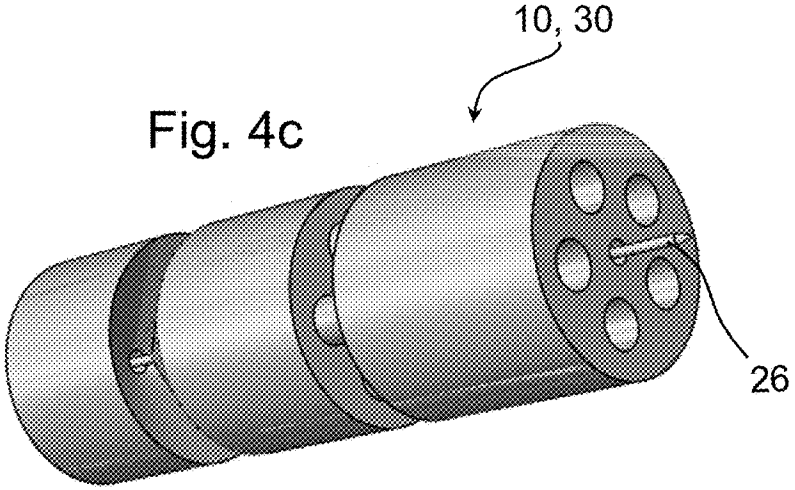
FIG. 4*c* is a perspective view similar to 4*b* showing an embedded transmission pin.
Figure 6A:
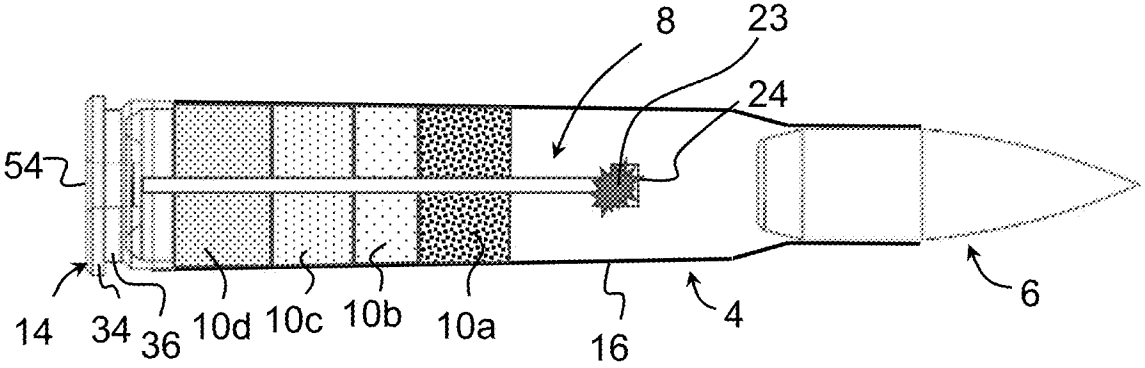
FIG. 6*a* is a schematic cross-sectional view of an ammunition cartridge according to another embodiment of the invention.
Figure 6B:
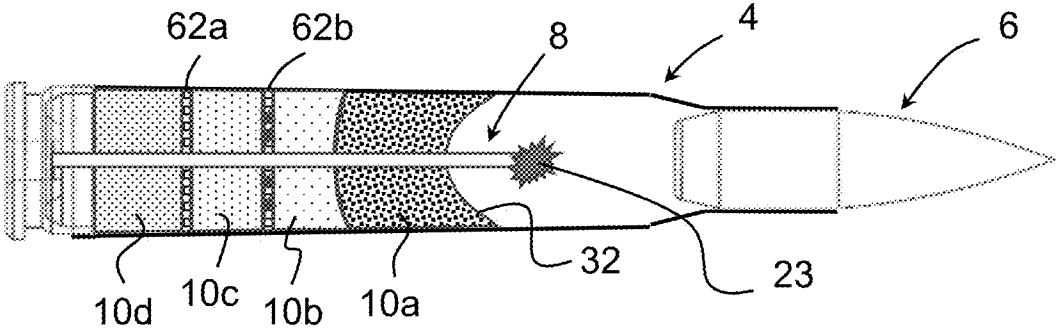
FIGS. 6*b* and 6*c* are schematic cross-sectional views of ammunition cartridges similar to FIG. 6*a* showing variants.
Figure 6C:
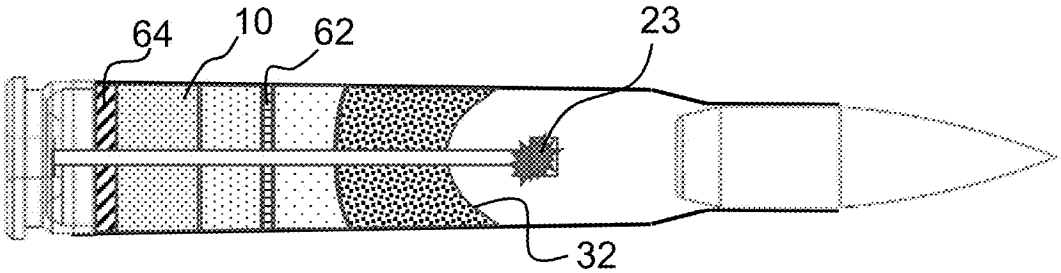
Figure 14B:
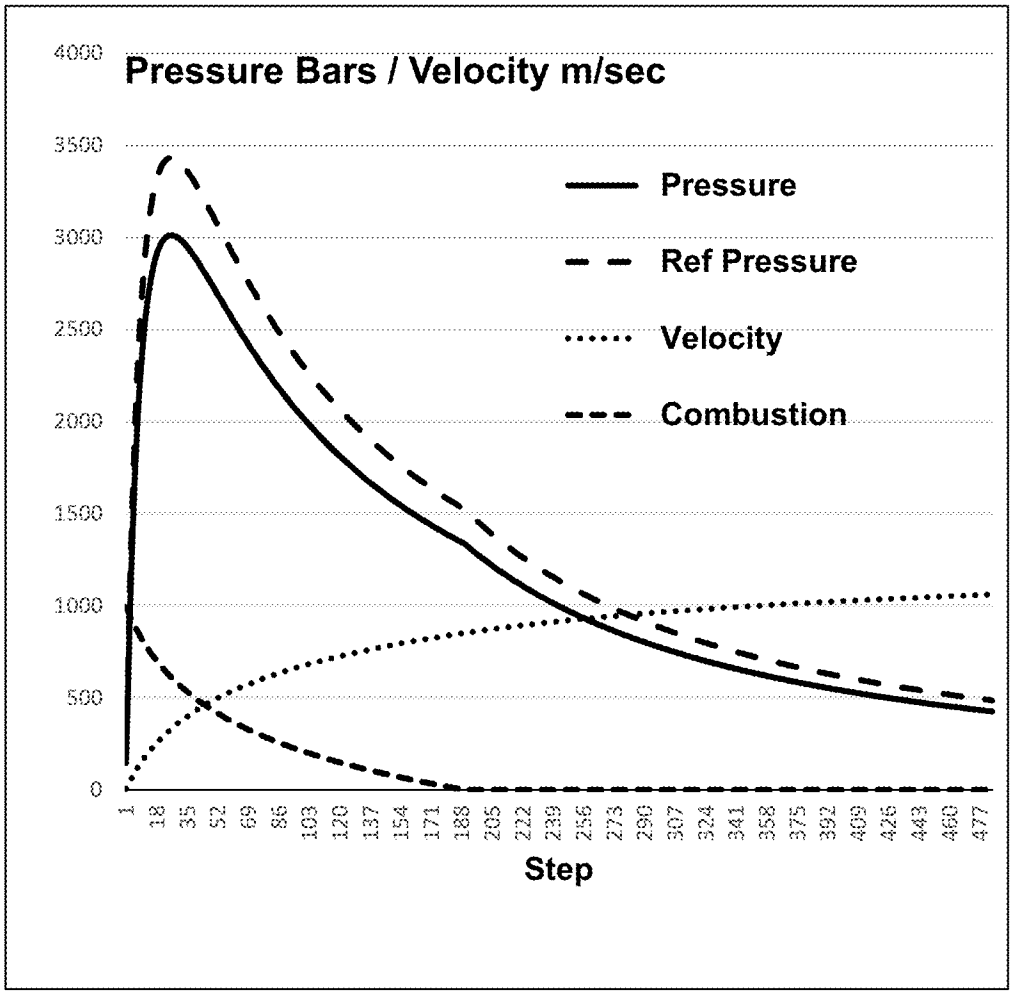
FIG. 14*b* is a graphical representation of the pressure, velocity and combustion profiles of a simulated combustion process using a single propellant with an ignition device located in the front part of the cartridge according to an embodiment of the invention and also showing the pressure profile for a conventional single propellant charge for comparison.
Figure 14C:
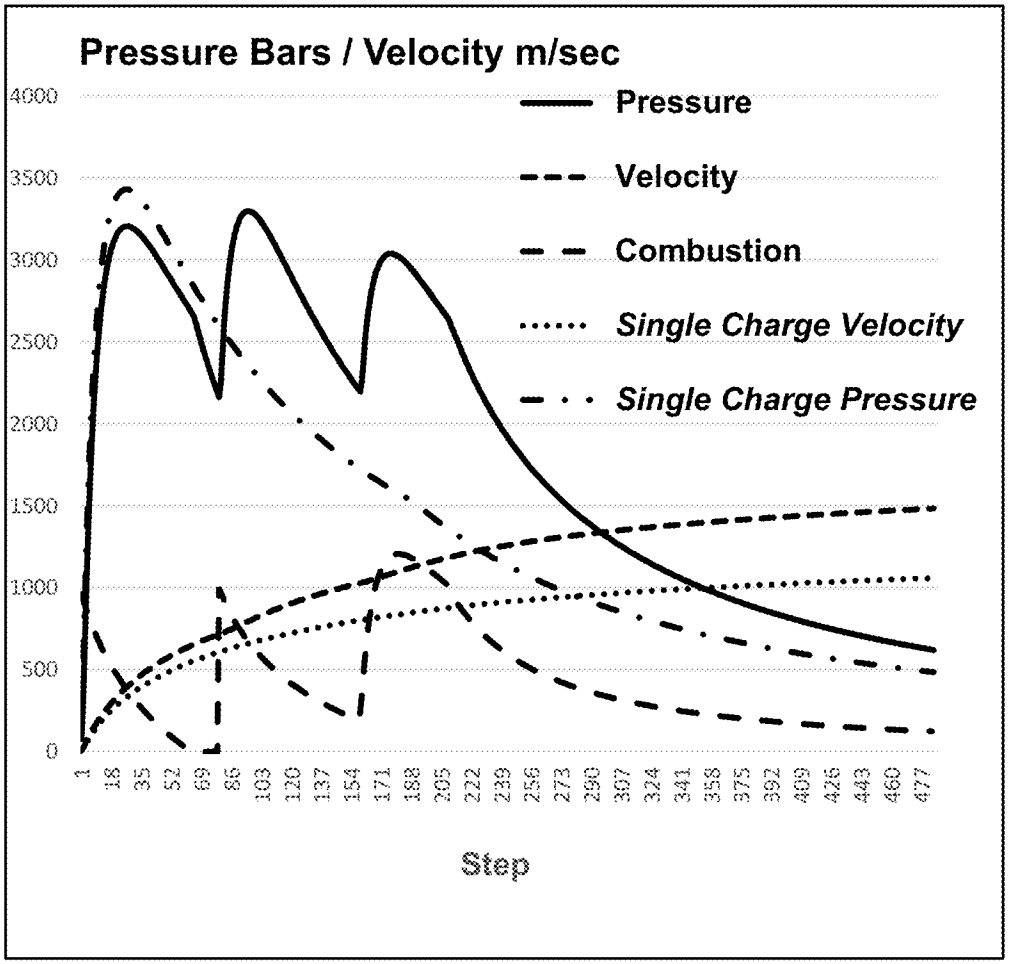
FIG. 14*c* is a graphical representation of the pressure, velocity and combustion profiles of a simulated combustion process using three successive propellant charges with an ignition device located in the front part of the cartridge according to an embodiment of the invention, and also showing curves for a convention single propellant charge for comparison.

Referring now to the embodiments illustrated in FIGS. 6*a* to 6*c*, in an advantageous configuration, the propellant charge may comprise a plurality of portions 10*a*, 10*b*, 10*c*, 10*d* of different composition or densities or structural properties, configured to provide different combustion characteristics. FIGS. 4*b* and 4*c* illustrate various embodiments of pre-formed propellant charges presenting different ways of imbricating them in one another in order to monitor combustion transfer between them. Extruded fingers inserted in the previous charge will advance combustion transfer before the latter charge is fully burned. Concave/Convex forms increase the interface between charges and with flat interfaces combustion will transfer at the end of the combustion of the previous charge. If flammable discs, not represented here, are placed between charges, combustion transfer will be monitored by the combustion characteristics of the disc material. The different combustion characteristics of the different charge portions may be determined empirically or via electronic modelling, or both, to optimize the combustion process. In an optimal combustion process, gas production and therefore gas expansion is configured to maintain a pressure close to peak pressure over a large portion of the full travel of the projectile in the barrel of the weapon for which it is intended to be used, as illustrated in FIG. 14*c*. The peak pressure can be set at or close to the maximum allowable pressure.

A mathematical simulation of the interior ballistic presented in FIG. 14*c* compares the pressure and velocity profiles produced by a single traditional charge ignited in the base of the cartridge and the pressure and velocity profiles produced by the successive action of three propellant charges ignited in the afore part of the cartridge. This mathematical model illustrates a good qualitative demonstration of the benefits that can be derived from embodiments of the invention.

The different charge portions 10*a*, 10*b*, 10*c*, 10*d* may either be made of different materials or be made of the same material but with different properties such as density of packing constituted to influence the rate of combustion and production of gas from the combusting propellant substance.

The propellant charge portions may also have components that retard or accelerate the combustion process. In a variant as illustrated in FIG. 6*b* or 6*c*, the charge portions 10*a*, 10*b*, 10*c*, 10*d* may be separated by combustion speed regulation materials 62, 62*a*, 62*b* selected to either retard or to accelerate combustion and thus increase or decrease the rate of gas production. The regulation material may include an inert material such as a thin plastic film or a small paper disc that simply retards the combustion process passing from one charge portion to the adjacent charge portion. The regulation material may include a combustible material, such as plastic propellants containing high-brisance crystalline explosives, with a higher combustion rate than the propellant charge substance, to accelerate combustion. The regulation material can be embedded in part in the preceding charge in order to transfer combustion to the next charge before the former one finishes burning. The regulation of ignition transfer among successive charges can also be realized by special coatings and/or treatments of their interfacing ends. Starches, gelatinizers, colloidal sprays and other binders can be advantageously used.

In general, it will be desirable to have a generally increasing rate of production of gas from the initial charge portion 10*a* towards the subsequent charge portions 10*b*, 10*c*, 10*d* in order to maintain a high substantially constant gas pressure within the expanding chamber behind the projectile as it accelerates along a gun barrel chamber. As the combustion of the hybrid charges 10*b*, 10*c*, 10*d* occur when the projectile is further down the barrel, they dispose of much a larger volume than in the case of a single charge. They can generate a much higher gas quantity without exceeding the pressure tolerance of the weapons as shown in FIG. 14*c* where the pressure, velocity and combustion profiles derived from a numerical simulation of the interior ballistic process involving three propellant charges demonstrates that the muzzle velocity, and the range, can be substantially increased without exceeding the pressure tolerance of the weapon. The optimal proportions of materials and rates of acceleration may be determined by experimental and empirical tests as a function of the actual intended use since the acceleration properties of the projectile will depend also on the configuration of the weapon and the size of the projectile taking into account pressure losses in the weapon.

In an advantageous embodiment, the first charge portion 10*a* immediately adjacent the ignition end 24 of the ignition device 8 may be advantageously provided with a curved or concave face 32 directed towards the ignition end in order to promote a more evenly distributed spatio-temporal ignition of the propellant charge. The curvature of the front face of the propellant charge is essentially designed to receive the thermal energy of the ignition process at a substantially even time. Such a configuration is possible with a propellant charge that is in a solid preform as previously discussed.

Although the propellant charge portions discussed here are illustrated as distinct separate portions, it will be appreciated that in variants it is possible to have a continuous transition of material properties or composition configured to change the rate of combustion and gas production.

Figure 3D:
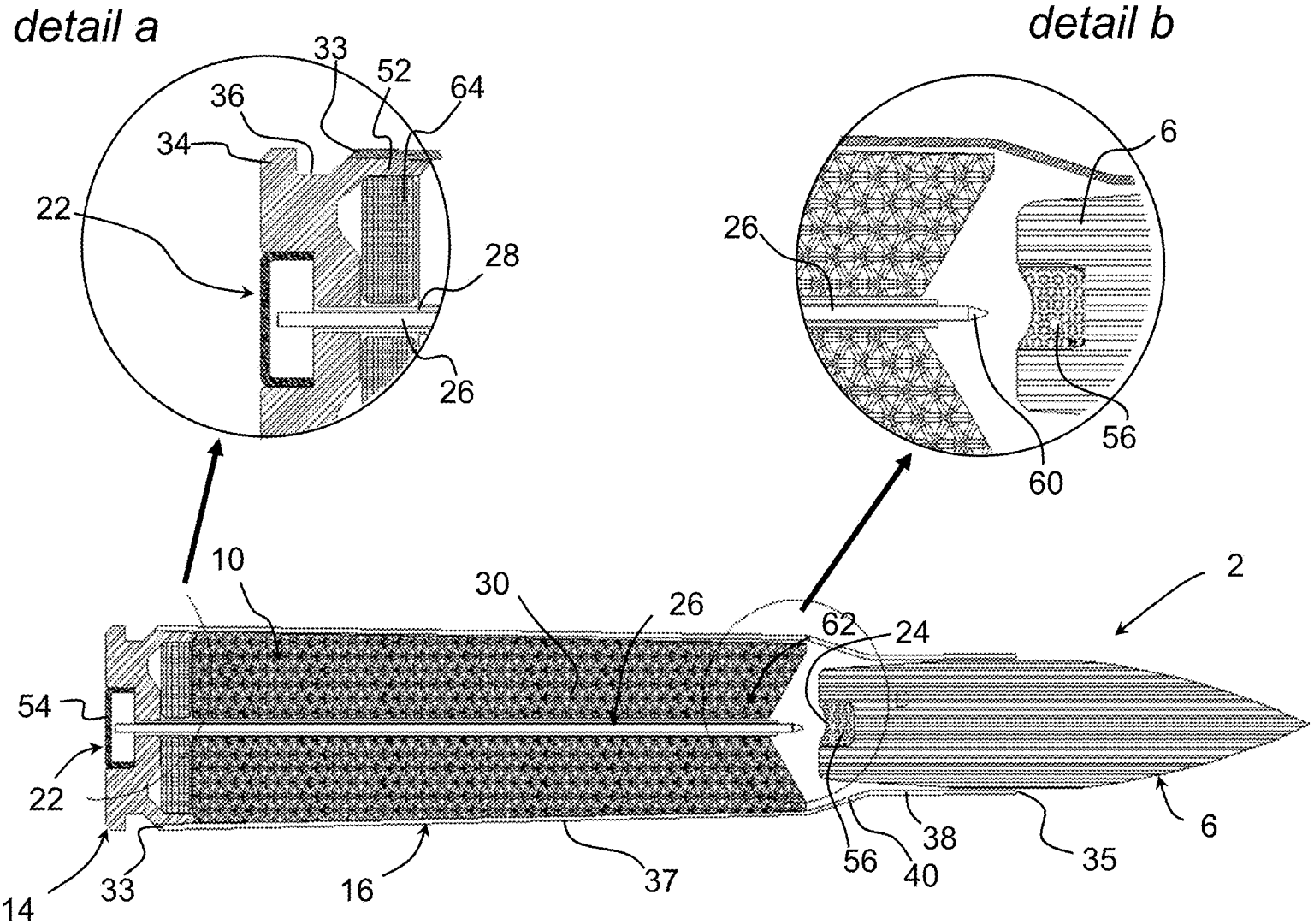
FIG. 3*d* is a schematic cross-sectional view of an ammunition cartridge similar to FIG. 3*a* but of a variant.
Figure 3E:
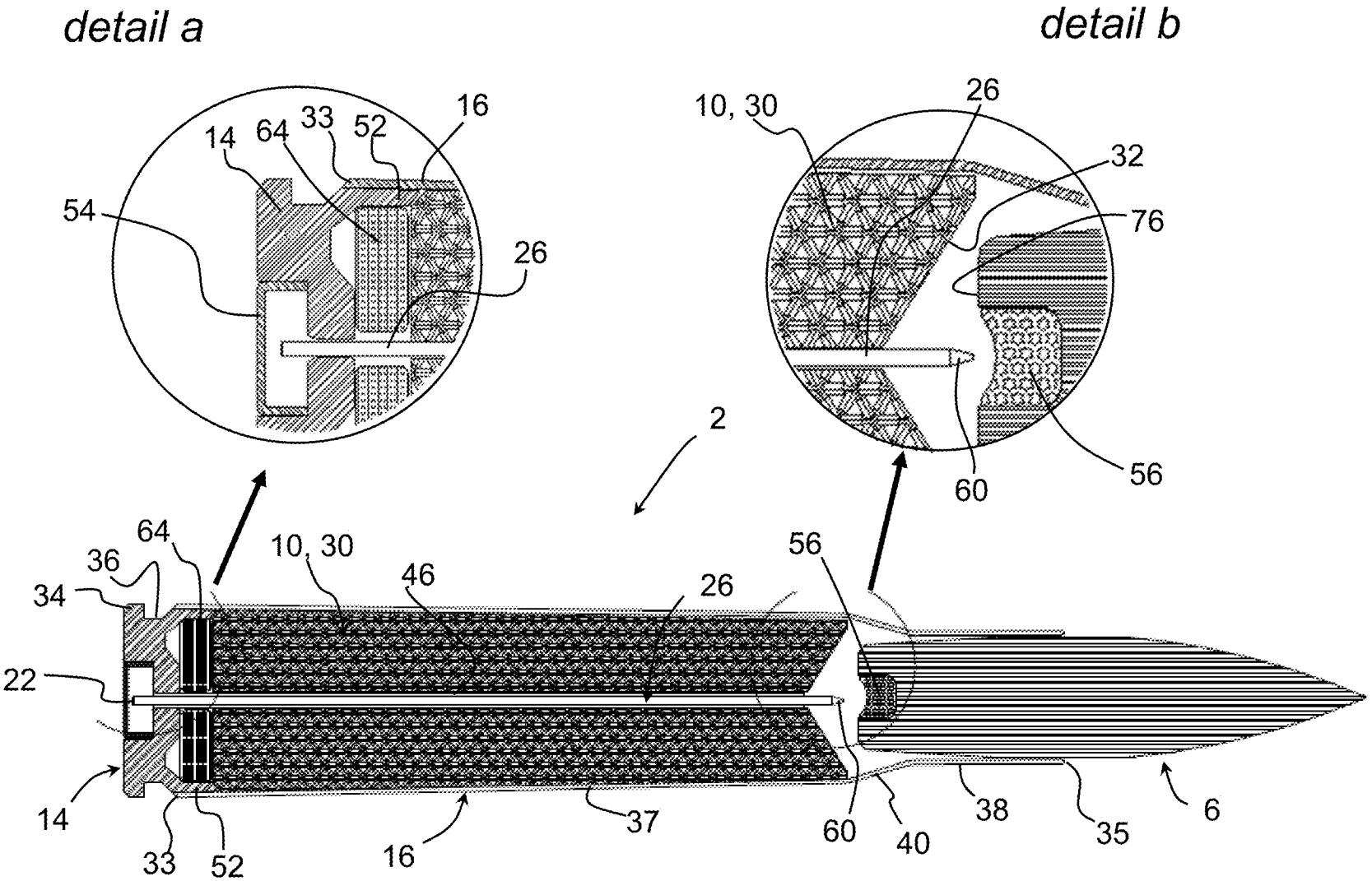
FIG. 3*e* is a schematic cross-sectional view of an ammunition cartridge similar to FIG. 3*d* but of a variant.

In an embodiment, as illustrated in FIGS. 3*c* to 3*e*, the base 14 may be separated from the propellant charge 10 by a thermal insulator 64. The thermal insulator may serve to reduce heat transmission from the base to the propellant charge during assembly of the base 14 to the tubular sleeve, in particular if a thermal bonding process such as welding, soldering or brazing is employed.

Referring now to FIGS. 7*d* to 8*b*, in an advantageous embodiment, the projectile may be further provided with a projectile booster charge 12 positioned adjacent a trailing end 76 of the projectile inside or behind the ignition charge. The trailing end of the projectile 6 may comprise a cavity 70 within which the projectile booster charge 12 is lodged. In variants however, the projectile booster charge may be positioned behind the projectile but not with a cavity of the projectile.

In an embodiment, the ignition charge 56 is positioned adjacent the projectile booster charge 12 such that it is ignited before the main propellant charge 10 is ignited.

The booster charge 12 serves to propel the projectile in its initial displacement out of the cartridge casing 4, and optionally into the barrel (not represented here), subsequently followed by the ignition of the main propellant charge 10 generating the combustion gas that accelerates the projectile during its travel in the barrel of the weapon. The ignition charge 56 may be separated by a thin film 48 from the propellant charge 10 in order to ensure that the booster charge 12 is ignited simultaneously or prior to the ignition of the propellant charge 10.

Figure 8A:
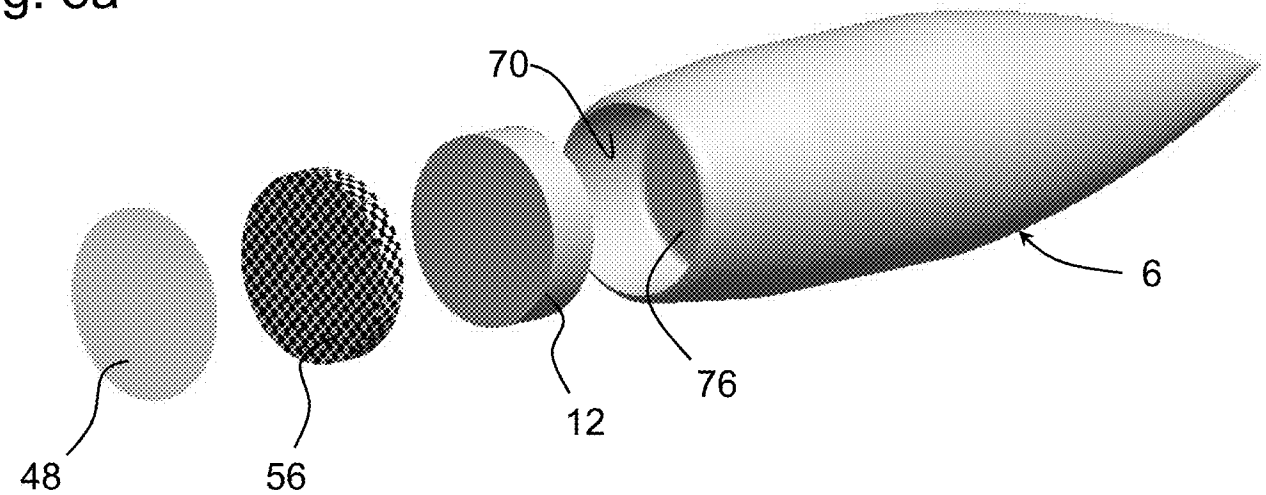
FIG. 8*a* is perspective schematic view of a projectile with an ignition charge and a booster charge of an ammunition cartridge according to an embodiment of this invention.
Figure 8B:
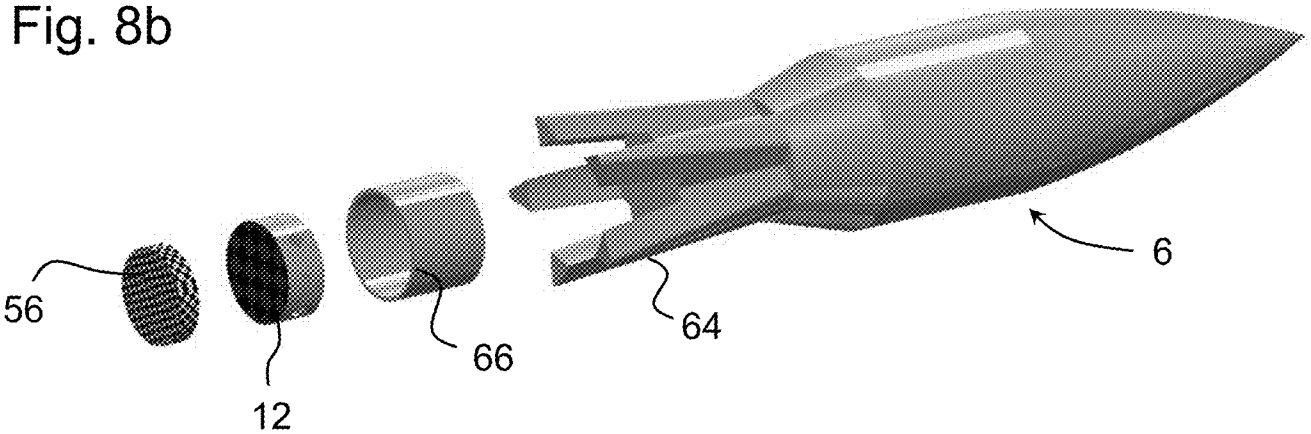
FIG. 8*b* is a schematic perspective view of a projectile with an ignition charge and a booster charge of a cartridge according to another embodiment of the invention.

As illustrated in FIG. 8*b*, in certain variants, for instance in a variant with fins 64 at the trailing end, the projectile booster charge 12 may be positioned within a tubular holder 66.

The use of the ignition charge 56, with or without a projectile booster charge 12, to eject the projectile from the cartridge casing 4 and to force it in the barrel plays an advantageous role in the interior ballistic process. It provides the main propellant charge 10, or the first block of hybrid charges 10*a*, a much larger initial volume that helps reducing significantly the peak pressure generated by the combustion. As illustrated by the simulation presented in FIG. 14*b*, a small pre-displacement of the order of a caliber length increases the free volume by several digits and reduces inversely the pressure generated by the combustion.

In a variant, the projectile booster charge may be included in or incorporated with the ignition charge 56 that may thus function as both a projectile booster charge and an ignition charge to ignite the propellant charge 10.

Referring to FIGS. 9 to 12*b*, an advantageous method of forming the cartridge casing 4 and in particular the tubular sleeve 16 of the cartridge casing is illustrated and will now be described. In this embodiment, the cartridge casing 4 is made of at least two parts as previously described. The tubular sleeve 16 is provided in the form of a tube that is for instance either extruded or formed from a flat sheet that is rolled into a tubular sleeve and welded or otherwise closed. The tubular sleeve initially has a constant diameter cylindrical shape whereby in order to form the neck portion 38 with the taper 40 it is necessary to have a forming step. In a conventional process, this forming step can lead to dimensional inaccuracies that reduce the performance of the ammunition cartridge due to the projectile 6 fitting within the neck portion 38 with more or less tightness. The more accurate the inner dimensions of the neck portion 38 are, the better the control of the fit between the projectile 6 and the cartridge casing 4.

In the illustrated embodiment, a casing forming tool mechanism 3 comprises a tool die 5 having a cavity portion with a shape corresponding to the outer shape of the ammunition cartridge casing 16, and a tool insert assembly 7 having a portion with a shape corresponding to an internal shape of the cartridge casing 16.

Figures 9, 10A, 10B, 10C, 10D:
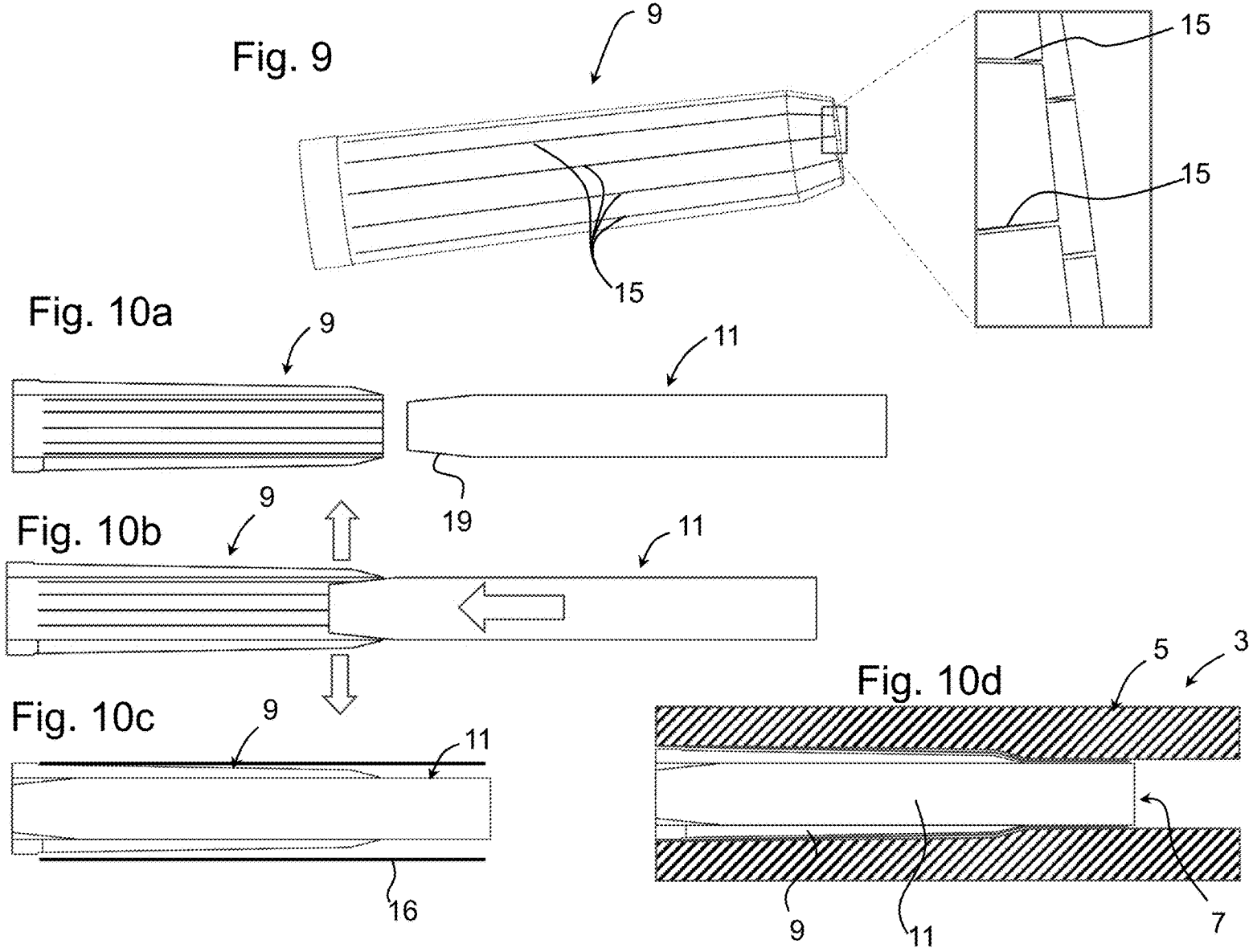
FIG. 9 is a perspective view of a shaper insert of a tool die mechanism for forming a casing of an ammunition cartridge according to an embodiment of the invention.
FIGS. 10*a* to 10*d* are schematic views illustrating steps in a casing manufacturing process according to an embodiment of the invention.

The tool insert assembly 7 according to an aspect of the invention is advantageously formed of at least two parts, a shaping insert 9 and a support pin 11 that slidably inserts into a central passage of the shaping insert 9. The shaping insert 9 comprises a radially compressible body portion 13 that allows the shaping insert 9 and in particular the tapered end portion thereof to compress radially inwardly to facilitate retraction of the insert from the tool die 5 after the casing tubular sleeve has been formed. Without the radially compressible shaping insert, extraction of the tool insert assembly from the tool die 5 may be very variable and difficult due to the inherent elasticity of the casing material. When the support pin 11 is inserted in the central passage of the shaping insert 9, the radially compressible shaping insert 9 becomes rigid and dimensionally accurate and the tool insert assembly 7 can be used for insertion within the tool die 5 to provide an accurate forming of the casing taper 40 and neck portions 38 as shown in FIG. 10*d*. At the end of this operation, the support pin 11 may be retracted from the shaping insert and subsequently the shaping insert 9 may be retracted whereby the radially elastic body portion 13 will allow easy removal of the shaping insert 9. The support pin 11 may be advantageously provided with a tapered entry portion 19 that allows easy insertion into the central passage of the shaping insert 9. The shaping insert may have a free-standing shape that is inwardly biased such that the diameter is slightly smaller than the diameter when the support pin and shaping insert are assembled together. The shaping insert thus radially inwardly contracts once the support pin is removed to allow easy removal of the shaping insert from the inside of the tubular sleeve casing.

Turning now to FIGS. 11*a* to 11*d*, in a variant the support pin 11 may be provided with a bore finishing tool portion 17 provided with hardened cutting edges that machine the inside of the neck portion as the support pin 11 is withdrawn at the end of the forming operation as illustrated in FIG. 10*d*. Any excess in the material thicknesses are thus removed by the retraction of this bore finishing tool portion that ensures accurate internal dimensions of the neck portion 38 for an exact desired fit with the projectile 6.

Figures 11A, 11B, 11C, 11D, 12A, 12B:
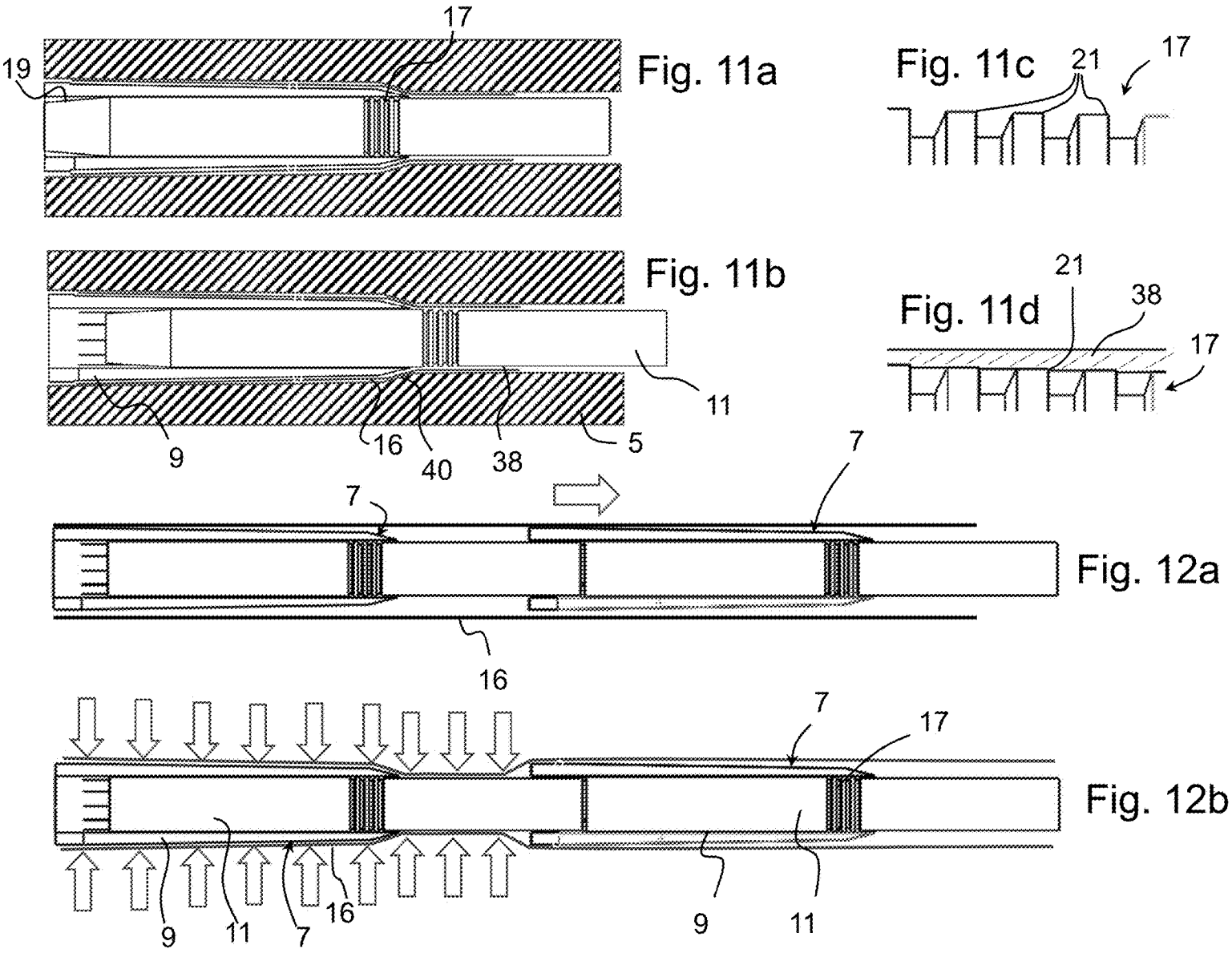
FIGS. 11*a* to 11*d* are schematic cross-sectional views showing steps of a manufacturing process of a cartridge casing according to another embodiment of the invention.
FIGS. 12*a* and 12*b* are schematic cross-sectional views showing steps of a manufacturing process of a cartridge casing according to another embodiment of the invention.

Referring to FIGS. 12*a* and 12*b*, in a variant of the casing forming tool mechanism, the tool die 5 may be replaced by various mechanical pressure means such as a rolling die or a multi component pressing die having jaws clamping around the cartridge casing, or by various non-mechanical pressure means based on pressure generated by hydrostatic, hydroelectric, or electromagnetic means. The tool insert assembly 7 comprising the shaping insert 9 and support pin 11 may be inserted within the cylindrical casing 16 before the forming thereof, whereby the pressure applied on the casing deforms the casing on the tool insert assembly to form the taper 40 and neck portions 38. A plurality of tool insert assemblies may be inserted in a length of tube corresponding to a plurality of cartridge casings whereby after the forming step the individual casings can be separated by various cutting operations such as by a cutting tool, a laser or by other per se known cutting techniques. In this variant, the support may also comprise a bore finishing cutting tool to ensure high dimensional accuracy of the inner surface of the neck portion as previously described. In a variant, two or more shaping inserts may be supported by a single support pin of corresponding length.

Figure 13:
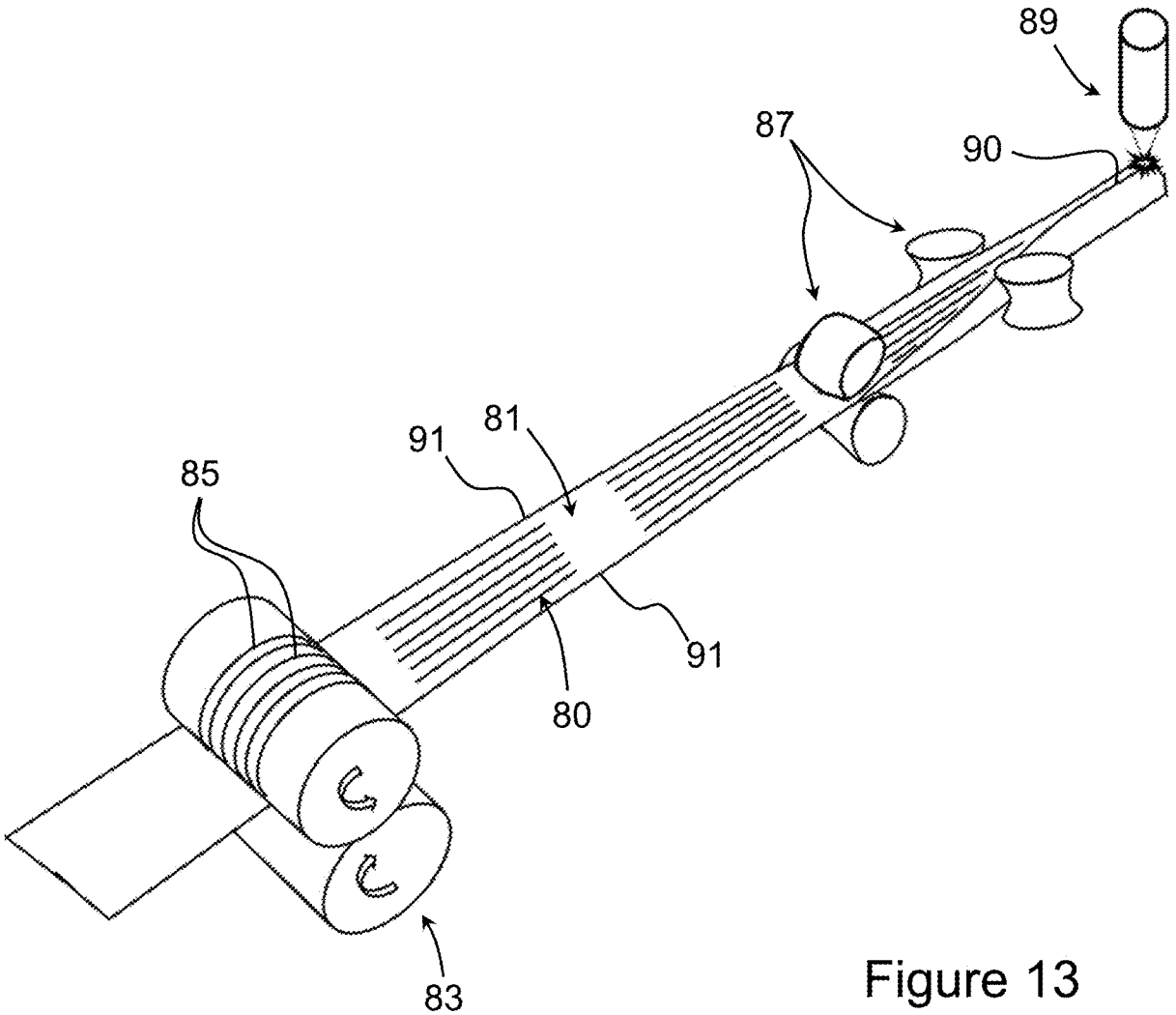
FIG. 13 is a schematic view illustrating a manufacturing process of sheet metal folded and welded tubular sleeves presenting grooves to improve the axial buckling resistance.

Referring to FIG. 13, a special arrangement is presented in order to produce stiffening grooves 80 formed by indents in a flat metal band 81. The metal band may advantageously be a steel band that allows to reduce costs and weight of the casing compared to conventional bras casings. The band is folded by a tube forming tool 87, that is per se well known in the art of tube forming from flat sheets, and welded by a welding station 89 along a longitudinal seam 90 formed by the coming together of the lateral edges 19 of the band 81 to form the tubular sleeve of the casing.

Embossing the grooves can be achieved by means of two counter rotating forming drums 83 with annular ribs 85 or they can be achieved by a standard press with appropriate stamping dies. Adding the stiffening grooves 80 to the band 81 increases the axial buckling resistance of steel band cartridge cylinders (tubular sleeves) and allows shaping them with an axial press as this is currently done with pressed cartridge bodies.

Without stiffening grooves, thin walled cylinders tend to buckle under axial pressures and require using supporting inserts as described previously. Axial buckling resistance is important because conventional ammunition presses offer, as to date, the highest production rates. In addition, stiffening grooves improve also the mechanical resistance to lateral shocks. Under the high pressures generated by the combustion of the propellant charge these groves also improve the radial elasticity of the cartridge casing, allowing it to press against the weapons combustion chamber. Since the plastic deformation of the cartridge can be reduced, if not avoided, a certain radial elasticity is recoverable as the pressure drops and the empty cartridge detaches itself from the combustion chamber, allowing its easier extraction form the weapon.

LIST OF REFERENCES IN THE DRAWINGS

Ammunition cartridge 2
Casing 4
Base 14
rim 34
Annular groove 36
Base wall 50
Tubular connection portion 52
Tubular sleeve 16
neck portion 38
taper 40
edge 42
base end 33
projectile end 35
Projectile 6
Tip 18
Centre portion 44
Base 20
Fins 64
Trailing end 76
Cavity 70
Ignition device 8
Point of ignition 23
Ignition cap 22
Transmission pin/tube 26
Ignition tip 60
Guide channel 28
Nozzles 58
Ignition charge 56
Cap 61
Actuation end 54
Ignition end 24
Propellant charge 10
propellant charge portions (first, second, third . . . ) stacked 10*a*, 10*b*, 10*c*, 10*d*
loose Powder, granules,
Solid preform 30
Concave face 32
Central passage 46
Charge timer 62, 62*a*, 62*b*
Insulator 64
Projectile booster charge 12
Protective film 48
Holder 66
Metal band 81
Edges 91
Indents/stiffening grooves 80
Casing forming tool mechanism 3
Tool die 5
Tool insert assembly 7
Shaping insert 9
Radially compressible body portion 13
Radial slits 15
Support pin 11
Bore finishing tool portion 17
Cutting edge 21
Tapered entry portion 19
Rolling press 83
Annular ribs 85
Tube forming tool 87
Welding station 89

The invention claimed is:

1. Ammunition cartridge for rifles and firearms, comprising a rigid casing including a tubular sleeve and a base closing an end of the casing, a projectile mounted at another end of the casing, a propellant charge contained inside the casing, and an ignition device, the ignition device comprising an ignition charge positioned in a cavity in the trailing end of the projectile, arranged to ignite the propellant charge at a point of ignition distal from the base and proximal the projectile, wherein the casing is made of at least two parts including the base and the tubular sleeve that are assembled together.

2. Ammunition cartridge according to claim 1, wherein the ignition device comprises a movable transmission pin, the transmission pin being actuable by means of a firing pin or hammer impacting an ignition cap on the base wall.

3. Ammunition cartridge according to claim 2, wherein the ignition pin is embedded in the propellant charge.

4. Ammunition cartridge according to claim 1, wherein the ignition charge is positioned in an ignition cap located at the base of the cartridge and the ignition device comprises a guide channel configured to channel an ignition charge under combustion to one or more nozzles at an ignition end of the guide channel proximal the projectile, the ignition charge located in the cap being actuable by means of a firing pin or hammer impacting the ignition cap on the base wall.

5. Ammunition cartridge according to claim 1, wherein the propellant charge comprises a plurality of portions of different composition or properties with different combustion characteristics.

6. Ammunition cartridge according to claim 1, wherein at least two of said portions of propellant charge have different densities.

7. Ammunition cartridge according to claim 1, wherein at least two of said portions of propellant charge have different chemical compositions.

8. Ammunition cartridge according to claim 1, wherein any one or more of the propellant charge portions comprise components that retard and/or accelerate the combustion process.

9. Ammunition cartridge according to claim 5, wherein at least two charge portions are separated by at least one combustion speed regulation material selected to either retard or to accelerate combustion.

10. Ammunition cartridge according to claim 1, wherein the propellant charge is in a shell type envelope or in a solid self-supporting preform.

11. Ammunition cartridge according to claim 10, wherein the propellant charge comprises a concave face facing towards the point of ignition.

12. Ammunition cartridge according to claim 10, wherein the propellant charge solid self-supporting preform comprises a combustion powder held together with a binding material.

13. Ammunition cartridge according to claim 12, wherein the binding material is selected from a group consisting of a starch-based material, a polymer based material, a curable polymer, a thermosetting polymer, a thermoplastic polymer, a gelatin material.

14. Ammunition cartridge according to claim 10, wherein the propellant charge solid self-supporting preform comprises an outer supporting layer.

15. Ammunition cartridge according to claim 1, further comprising a projectile booster charge positioned adjacent a trailing end of the projectile.

16. Ammunition cartridge according to claim 15, wherein the projectile booster charge is positioned in a cavity in the trailing end of the projectile.

17. Ammunition cartridge according to claim 15, wherein the point of ignition of the projectile booster charge is positioned adjacent the ignition device such that the projectile booster charge is ignited simultaneously or before the propellant charge is ignited.

18. Ammunition cartridge according to claim 1, wherein the point of ignition is separated by a thin film from the propellant charge.

19. Ammunition cartridge according to claim 1, wherein said base and tubular sleeve are Laser welded.

20. Ammunition cartridge according to claim 1, further comprising a thermal insulator positioned between the base and the propellant charge.

21. Ammunition cartridge according to claim 1, wherein the projectile comprises aerodynamic tail fins at a trailing end of the projectile.

* * * * *